United States Patent [19]

Magid

[11] Patent Number: 4,513,884

[45] Date of Patent: Apr. 30, 1985

[54] DISPENSING SYSTEM AND A REFILL POUCH

[75] Inventor: David J. Magid, Doylestown, Pa.

[73] Assignee: Enviro-Spray Systems, Inc., Montgomeryville, Pa.

[21] Appl. No.: 365,552

[22] Filed: Apr. 5, 1982

[51] Int. Cl.[3] ..... B65D 83/14

[52] U.S. Cl. ..... 222/94; 222/327; 222/386.5

[58] Field of Search ..... 222/94–95, 222/131, 183, 325–327, 386.5, 399, 394

[56] References Cited

U.S. PATENT DOCUMENTS

| | | | |
|---|---|---|---|
| 2,888,173 | 5/1959 | Wolcott | 222/183 |
| 2,912,018 | 11/1959 | Leech . | |
| 2,976,877 | 3/1961 | Beckworth . | |
| 3,023,750 | 3/1962 | Baron | 222/386.5 X |
| 3,282,473 | 11/1966 | Moore | 222/399 X |
| 3,282,510 | 11/1966 | Van Schwartz . | |
| 3,417,901 | 12/1968 | Sands | 222/386.5 X |
| 3,512,685 | 5/1970 | Ewald | 222/399 X |
| 3,513,886 | 5/1970 | Easter et al. . | |
| 3,718,236 | 2/1973 | Reyner et al. | 222/386.5 X |
| 3,834,589 | 9/1974 | Morane et al. | 222/399 X |
| 4,049,158 | 9/1977 | Lo et al. . | |
| 4,161,970 | 7/1979 | Lamb | 222/327 X |
| 4,174,811 | 11/1979 | Binder et al. . | |
| 4,231,492 | 11/1980 | Rios | 222/327 X |
| 4,379,453 | 4/1983 | Baron | 222/386.5 X |

FOREIGN PATENT DOCUMENTS

| | | | |
|---|---|---|---|
| 6602958 | 9/1966 | Netherlands | 222/94 |

*Primary Examiner*—Charles A. Marmor

*Attorney, Agent, or Firm*—Kenyon & Kenyon

[57] ABSTRACT

The refill pouch is constructed of a flexible pouch containing a product to be dispensed and an expandable bag containing a gas generating system for expanding the bag. Upon placement in a container with a valve, the pouch can be opened and the gas generating system activated. After dispensing of a product, the container can be emptied and a fresh refill pouch placed within the container.

11 Claims, 4 Drawing Figures

DISPENSING SYSTEM AND A REFILL POUCH

This invention relates to a dispensing system and to a refill pouch. More particularly, this invention relates to a refillable pressurized dispensing system.

Heretofore, various types of dispensing systems, such as the aerosol-type and manual pump-type, have been used for dispensing products from containers. More recently, dispensing systems have been known, such as described in U.S. patent application Ser. No. 223,422, filed Jan. 8, 1981, now U.S. Pat. No. 4,360,131 which employ an expansion means within a container for developing and maintaining a relatively constant gaseous dispensing pressure for the product which is to be dispensed.

Generally, these dispensing systems have been constructed so that when the product has been dispensed, the container is discarded. This, of course, has created environmental problems not only in terms of waste of a resource but also in terms of the eventual disposal or re-cycling of empty containers.

Further, in those cases where the systems are pressurized at the site of filling, the pressurized containers require additional care and packaging for shipping and storage prior to sale to an ultimate consumer.

As a consequence of the above features, the dispensing systems which have heretofore been used are generally expensive.

Accordingly, it is an object of the invention to provide a dispensing system which does not require pressurization until reaching the ultimate consumer.

It is another object of the invention to permit an ultimate consumer to reuse the container of a dispensing system.

it is another object of the invention to provide a refill insert for a dispensing system which can be shipped and stored separately.

It is another object of the invention to lower the cost and risks of shipping products for a dispensing system.

It is another object of the invention to permit a container of a dispensing system to be used repeatedly.

Briefly, the invention provides a dispensing system which is comprised of a pressure resistant container and a pouch containing a product to be dispensed. The container is provided with a removable cover and an outlet while the pouch is sized to fit into the container. The pouch contains a prepackaged flowable product and a sealed expandable bag which contains means for expanding the pouch in order to dispense the product from the pouch into the container and, thence, through the container outlet.

The container is also provided with a means such as a valve for controlling the flow of product from the container from time to time.

The means which is used to expand the bag in the pouch may be a gas generating means, for example as described in U.S. patent application Ser. No. 223,422, filed Jan. 1, 1981.

For fabrication, with the pouch in an initially open condition, the product to be eventually dispensed is charged into the pouch. The sealed expandable bag is then placed in the pouch. Thereafter, the pouch is sealed and then shipped in an unpressurized state for sale to an ultimate consumer. Since the pouch is not pressurized, a separate pressure resistant container is not required at this time. Therefore, there is considerable savings in weight for the shipment of the product as well as for the storage of the product.

After the ultimate consumer obtains the refill pouch and is ready to refill a previously used container, the pouch is opened, for example, by removing a tab to expose the contents. Next, the gas generating means is activated and the opened pouch is placed in the container. The cover of the container is then secured in place. Thereafter, as the expandable bag expands under the pressure of the generated gas, the contents of the container are placed under pressure. Upon actuation of the valve of the container, the product can then be dispensed from time to time.

After all the product has been dispensed from the container, the container can be opened and the contents discarded. In this regard, the container may be provided with a sealed opening for insertion of a tool, such as a needle to burst the expanded bag. After dissipating the gas pressure within the container, the cover can then be removed so that the contents can be discarded. Thereafter, a fresh pouch can be placed within the container using the above procedure.

These and other objects and advantages of the invention will become more apparent from the following detailed description taken in conjunction with the accompanying drawings wherein.

Figure 4:
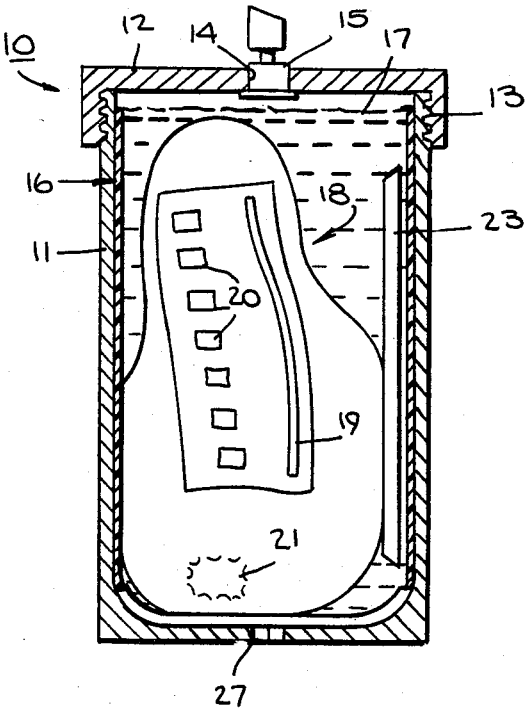
FIG. 4 illustrates a closed container of a dispensing system according to the invention.

Referring to FIG. 4, the dispensing system includes a container 10, for example a pressure resistant container of cylindrical shape, having a main body portion 11 with an open upper end and a cover 12 which is secured to the body portion 11 in seal tight manner, for example via threading 13. As indicated, the cover 12 has a centrally located outlet 14 in which a valve 15 is positioned to control the flow of a product through the outlet 14. The valve 15 is of any suitable type through which a pressurized flowable product may be dispensed.

The dispensing system also includes a pouch 16 which is disposed within the container body 11 and which contains a flowable product 17 and a sealed expandable bag 18. The bag 18, in turn, contains means, such as a gas generating means, for expanding the bag 18 within the pouch 16.

The gas generating means may include two gas generating components which, upon admixture in successive amounts, generate gas to cause the bag 18 to expand gradually from a collapsed condition (FIG. 2) to an ultimately fully expanded condition. As indicated, the bag 18 is constructed with a plurality of compartments 20 which contain separate charges of one of the gas generating components. The bag 18 may have an insert forming the compartments 20 which is secured to the bag 18 during fabrication by a separation weld 19 as is known. In addition, the bag 18 has a compartment 21 at one end in which an initial charge of the first gas generating component is disposed and an adjacent burstable compartment 22 in which the second gas generating compartment is disposed. For example, the compartment 21 may be filled with bicarbonate of soda while the burstable compartment 22 is filled with a citric acid solution. The bag 18 is constructed so that upon bursting of the compartment 22, the citric acid solution admixes with the bicarbonate in the compartment 21 to generate a gas. As indicated in FIG. 4, as the bag 18 expands over time, the remaining compartments 20 which are charged with additional bicarbonate are sequentially dispensed into the citric acid solution so that additional gas is generated.

The construction of the gas generating means is similar to that as described in U.S. patent application Ser. No. 223,422, filed Jan. 8, 1981. Hence, further description is not believed to be necessary.

Figure 1:
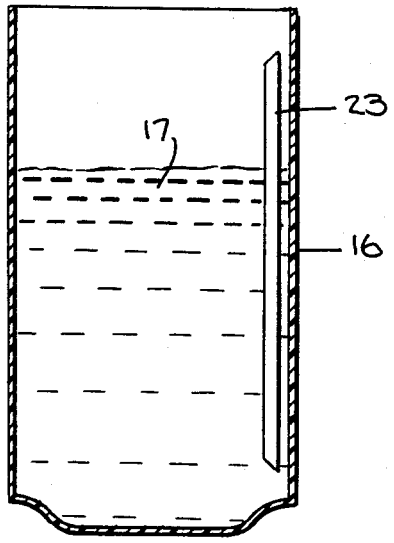
FIG. 1 illustrates a side view of an initially open pouch containing a flowable product in accordance with the invention.

Referring to FIG. 1, the flexible pouch 16 is initially formed with one open end. The product 17 is charged into the pouch 16 through this open end and a siphon 23 is disposed within the pouch 16. As indicated in FIG. 4, the siphon 23 is in the form of a tube which permits the lower portions of the container 10 to communicate with the upper portions of the container 10 to insure against the product 17 becomming trapped below the confines of the expanded bag 18.

Figure 2:
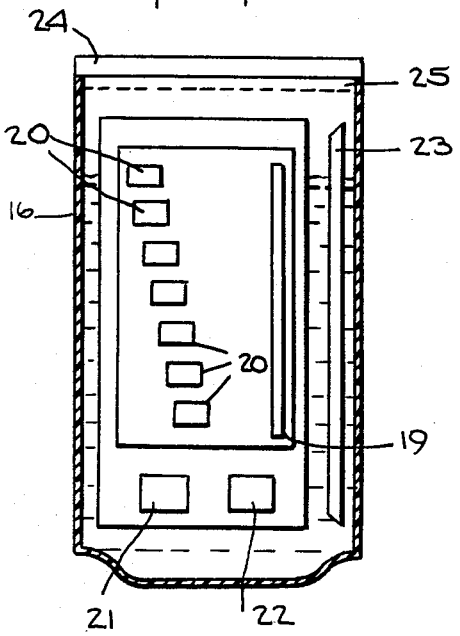
FIG. 2 illustrates a side view of a sealed refill pouch with a sealed expandable bag having a gas generating means therein in accordance with the invention.

Referring to FIG. 2, after charging of the pouch 16 with the product 17, the sealed expandable bag 18 is placed within the pouch 16. Alternatively, depending on the nature of the product 17, the bag 18 may be placed in the pouch 16 before the product 17. Thereafter, the open end of the pouch 16 is sealed. In this regard, with the pouch 16 being made of a heat sealable plastic or laminated foil material, the open edges of the pouch 16 are brought together and heat sealed to form a seal 24. Once sealed, the pouch 16 and the contents define a refill pouch 16 which can be shipped in bulk, for example to a sales outlet, for distribution to an ultimate consumer.

As indicated in FIG. 2, the pouch 16 is provided, for example, with a removable tab 25 at the end where the seal 24 is made for purposes as explained below.

Figure 3:
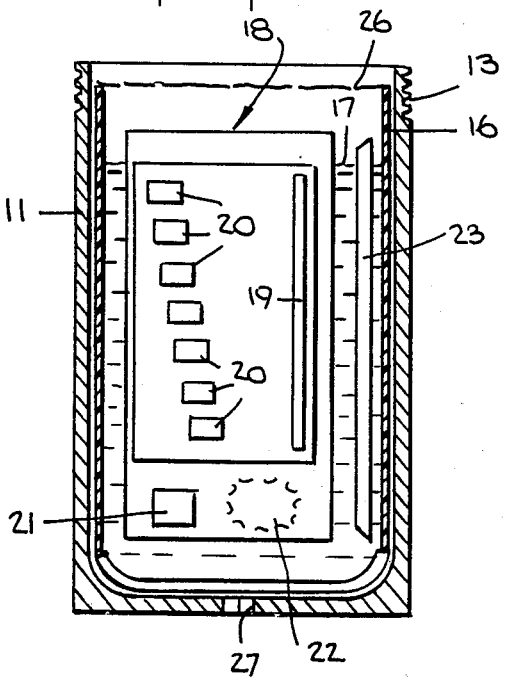
FIG. 3 illustrates an opened container at the time of inserting a refill pouch in accordance with the invention.

Referring to FIG. 3, when a refill pouch 16 is to be used, the ultimate consumer opens a previously used and emptied container 10. Next, the burstable compartment 22 of the expandable bag 18 is burst, for example manually. The top of the pouch 16 is then cut or the tab 25 is removed to form an opening 26 in the pouch 16. Next, the opened pouch 16 is placed within the container body 11 and the cover 12 is secured in place (FIG. 4). The dispensing system is thus ready for use.

As the bag 18 expands, the product 17 is placed under pressure sufficient to permit dispensing via the valve 15 when activated. Further, the opened pouch 16 defines a liner for the body portion 11 of the container 10. As such, the pouch 16 can serve to protect the inside of the container 10 against corrosion and the like.

Referring to FIG. 4, the container body 11 is provided with a sealed opening, for example defined by a rubber valve 27, in the bottom through which a tool, such as a needle, (not shown) can be inserted for bursting of the expanded bag 18 when the container 10 is to be refilled. For example, after the product 17 has been completely dispensed, or substantially so, the needle is inserted through the valve 27, pouch 16 and bag 18 so that the gas within the expanded bag 18 can be dispelled from the container 10 via the valve 15. The container 10 can then be opened and cleaned for subsequent refilling.

Alternatively, the pouch 16 may be constructed without a removable tab. For example, the pouch 16 may be formed with a section which can be cut to form an opening for the contents. Also, the pouch may have a peelable peel-back flap which can be peel back to open the pouch, for example, by the pressure which is generated by the expanding bags 18.

Further, the pouch 16 can be made of any suitable material for the packaged product. For example, the pouch 16 may be made of a moisture and chemically resistant material as is known for food.

Of note, the amount of force necessary for actuating the gas generating means should be sufficient to prevent a premature activation but suitable for manual application.

The invention thus provides a refill pouch which can be readily shipped in bulk in a reduced space without the need for shipment within a dispensing container. Further, the product to be dispensed can be shipped in an unpressurized state. As a result, the cost of shipping, storage and the like can be reduced.

Since the ultimate consumer can use a single container repeatedly with a series of refill inserts, there is no need to discard the container. As a result, recycling and discarding of a used container need not be of concern.

Of further note, the cost of the product to the consumer can be reduced since there is no need to pay for costly packaging of the product in separate containers. By reusing the original container, the consumer should have the benefit of these savings since payment is only made for the initial container and not for the packaging and manufacturing of subsequent containers.

The refill pouch may be used with different types and sizes of containers; for example, aerosol-type containers, garden spray type containers, paint can sizes and the like.

Further, the refill pouch may be used to package a concentrated product. In such cases, after opening such a pouch, water or other suitable material, would be added to the concentrate. The gas generating means would then be activated and the opened pouch placed in a suitable dispensing container for use as described above. This type of pouch is of particularly low weight and further holds down the shipping weight of the packaged product to be dispensed.

What is claimed is:

1. A reusable pressurized dispensing system adapted for use in seriatum fashion with a plurality of pouches which contain therein the product to be dispensed and which comprises container means including an opening therein adapted to house a pouch including therein the product to be dispensed;

removable closure means adapted to cover said container opening;

outlet means disposed in said removable closure means through which the product within the pouch is dispensed;

a sealed inflatable pouch including therein a prepackaged flowable product to be dispensed and which is disposed within said container means, said inflatable pouch being adapted to define a liner within said container upon expansion thereof;

a sealed expandable pressure generating bag disposed within said inflatable pouch for exerting pressure on said flowable product within said pouch;

means within said bag for expanding said bag within said pouch to dispense said prepackaged flowable product from said pouch through said container outlet means;

means for activating said bag expanding means disposed within said pouch;

means for generating additional bag expansion as product is dispensed from said pouch through said container outlet; and means for opening said pouch to facilitate communication of said flowable product contained therein with said outlet means whereby said flowable product may be dispensed from said container.

2. A reusable pressurized dispensing system in accordance with claim 1 wherein said inflatable pouch is flexible so as to substantially conform to the shape of the inner portion of said container means upon expansion thereof.

3. A reusable pressurized dispensing system in accordance with claim 1 wherein said container means is substantially cylindrical in shape having an opening in the top thereof and wherein said removable closure means has a circular shape and is adapted to be fastened to the top of said container means.

4. A reusable pressurized dispensing system in accordance with claim 1 wherein said container means includes a second opening therein suitable for insertion of a piercing means therethrough adapted to puncture said expandable pouch prior to removal thereof.

5. A reusable pressurized dispensing system in accordance with claim 1 which further comprises a valve means disposed in said outlet means for controlling the dispensing of said prepackaged flowable product from said container.

6. A refill pouch containing a prepackaged product to be dispensed adapted for use in association with a pressurized dispensing container having an opening therein to facilitate insertion and housing of the pouch therein, a closure means for the opening and an outlet in the closure for dispensing the prepacked product which comprises:

a sealed inflatable pouch including therein a prepackaged flowable product to be dispensed and which is adapted to be disposed within a substantially pressure resistant container, said inflatable pouch being adapted to define a liner within said container upon expansion thereof;

a sealed expandable pressure generating bag disposed within said inflatable pouch for exerting pressure on said flowable product within said pouch;

means within said bag for expanding said bag within said pouch to dispense said prepackaged flowable product from said pouch through a container outlet;

means for activating said bag expanding means disposed within said pouch adapted for activation prior to insertion into said container;

means for generating additional bag expansion as product is dispensed from said pouch through the container outlet; and means for opening said pouch to facilitate communication of the flowable product container therein with said container outlet whereby the flowable product may be dispensed from a reusable container.

7. A refill pouch in accordance with claim 6 wherein said inflatable pouch is flexible to substantially conform to the shape of the inner portion of the reusable container upon expansion thereof.

8. A refill pouch in accordance with claim 6 wherein said pouch includes a removable tab for opening of said pouch.

9. A refill pouch as set forth in claim 6 which further includes a siphon tube therein.

10. A refill pouch as set forth in claim 26 wherein said bag expanding means is a gas generating means.

11. A refill pouch as set forth in claim 6 wherein said product housed therein is a concentrate.

* * * * *